United States Patent [19]

Feigenbaum

[11] Patent Number: 4,733,243

[45] Date of Patent: Mar. 22, 1988

[54] BROADBAND HIGH FREQUENCY SKY-WAVE ANTENNA

[75] Inventor: Bernard E. Feigenbaum, Neptune, N.J.

[73] Assignee: The United States of America as represented by the Secretary of the Army, Washington, D.C.

[21] Appl. No.: 943,095

[22] Filed: Dec. 18, 1986

[51] Int. Cl.[4] ..... H01Q 11/10

[52] U.S. Cl. ..... 343/736; 343/792.5; 343/860

[58] Field of Search ..... 343/792.5, 731, 739, 343/829, 846, 859, 860, 806, 735–738, 740, 825, 828, 830, 845, 848

[56] References Cited

U.S. PATENT DOCUMENTS 3,221,332 11/1965 Kravis et al. ..... 343/792.5
3,276,027 9/1966 Bell et al. ..... 343/792.5
3,369,243 2/1968 Greiser ..... 343/792.5
4,286,271 8/1981 Barbano et al. ..... 343/792.5

FOREIGN PATENT DOCUMENTS 563493 8/1944 United Kingdom ..... 343/739

*Primary Examiner*—William L. Sikes
*Assistant Examiner*—Michael C. Wimer
*Attorney, Agent, or Firm*—Sheldon Kanars; Jeremiah G. Murray; John K. Mullarney

[57] ABSTRACT

A broadband H.F. directional sky-wave antenna system comprises a plurality of interconnected, vertical, zig-zag, antenna sections of predetermined increasing height. A counterpoise is utilized to balance the antenna. Power is coupled to the shortest zig-zag section via an impedance matching transformer. A resistance is used to terminate the antenna in its characteristic impedance.

3 Claims, 6 Drawing Figures

BROADBAND HIGH FREQUENCY SKY-WAVE ANTENNA

The invention described herein may be manufactured, used and licensed by or for the Government for governmental purposes without the payment to me of any royalties thereon.

TECHNICAL FIELD

The present invention relates to a relatively small, broadband, high frequency, directional antenna for producing the low-angle radiation necessary for long-range communication by sky-wave propagation.

BACKGROUND OF THE INVENTION

Effective high frequency (HF) antennas, which are compatible with the varied and demanding requirements peculiar to military tactical communications, are by no means easily engineered. Military radios operate over a broadband (e.g., 3–30 MHZ) and vary in power from watts to kilowatts. The communication systems are often fixed, but must be transportable by vehicular, man-portable or airborne means and often necessitate ionospheric propagation over long range paths.

The required mobility would suggest small antenna size of light weight, but electrical performance will be compromised if the antenna is made too small in terms of the wavelength(s). The necessary broad frequency range which typically spans three octaves or more complicates the design of efficient antennas.

The conventional log-periodic dipole array (LPDA) generally offers good efficiency and broad bandwidth and has been used heretofore for military communication purposes. A commercially available log-periodic dipole antenna which has been utilized as the base station antenna for military communication purposes is the AS-317A/TSC-99 antenna made by Technology Communications International Co. (T.C.I.). While this antenna is satisfactory in the above-mentioned respects, it is unwieldy, difficult and time consuming to deploy, expensive, and because of its very large physical size the number of possible sites is restricted by political, economic, logistic, and other considerations (e.g., zoning approval).

SUMMARY OF THE INVENTION

It is the primary object of the present invention to achieve a broadband, high frequency (H.F.), directional, sky-wave antenna design that is small compared to current broadband H.F. sky-wave antennas.

A related object of the invention is to provide a sky-wave antenna that is relatively small, light-weight, inexpensive, and easy to deploy.

The foregoing and other objects are achieved in a preferred embodiment of the present invention wherein a given number (e.g., 10) of interconnected, vertical, zig-zag, antenna sections are of predetermined increasing height. The antenna is terminated by an appropriate resistance so as to maintain the characteristic impedance over the entire frequency range of interest. A counterpoise is utilized to balance the antenna system. Power is coupled to the shortest zig-zag section via an impedance matching transformer. The currents that are induced on the antenna cause power to radiate at low elevation angles.

It is an advantageous feature that, unlike the conventional vertical log-periodic antenna, the zig-zag antenna of the present invention is a non-resonant, log-periodic, directional antenna which achieves a single main beam by virtue of satisfying a condition (i.e., Hanson-Woodyard) for significantly increased directivity.

BRIEF DESCRIPTION OF THE DRAWINGS

The invention will be more fully appreciated from the following detailed description when the same is considered in connection with the accompanying drawings, in which.

DETAILED DESCRIPTION

Figure 1:
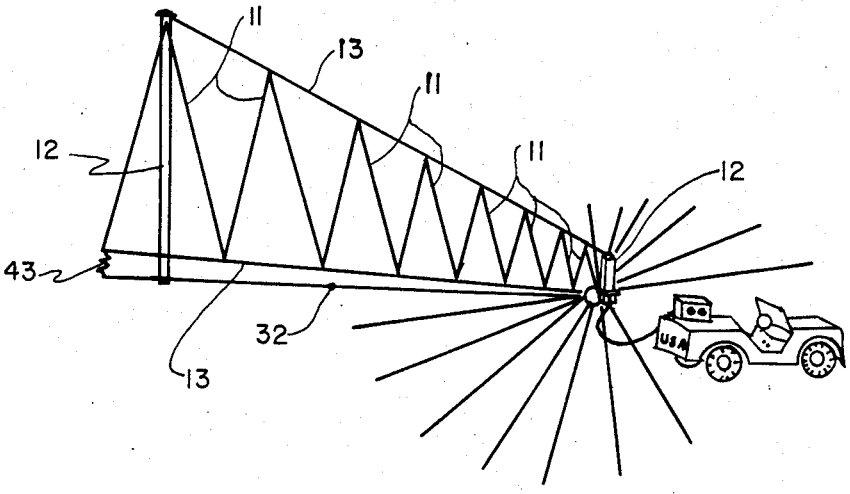
FIG. 1 shows a zig-zag antenna system in accordance with the present invention.
Figure 2:
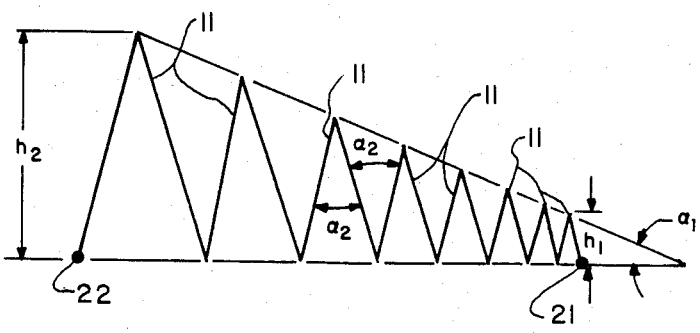
FIG. 2 shows the zig-zag antenna, per se.

Turning now to FIGS. 1 and 2 of the drawings, an antenna in accordance with the present invention is shown to comprise a plurality of vertical, zig-zag, antenna sections 11 of predetermined increasing height (h). While only eight interconnected zig-zag or triangular sections are shown in FIGS. 1 and 2, the preferred embodiment of the invention comprises 10 sections±2 sections. However, it is to be understood that the invention is not so limited and might comprise even more or fewer zig-zag sections; the exact number of sections utilized will represent a compromise or trade-off between antenna size and performance. In the preferred embodiment, the shortest section has a height $h_1=1.0$ meter, while the height of the tallest section $h_2=10$ meters. The heights $h_1$ and $h_2$ are inversely proportioned to $f_1$ and $f_2$, the high and low frequencies, and thus are determined in great part by the frequency band to be propagated. As indicated in FIG. 2, the increasing height of the successive zig-zag sections is defined by the angle $\alpha_1$, which in the preferred embodiment is 30 degrees±5 degrees. The angle $\alpha_2$ of the zig-zag sections is also preferable 30 degrees±5 degrees. However, once again, it is to be understood that these values for the angles $\alpha_1$ and $\alpha_2$ are given by way of example and the invention is not so limited. Further, $\alpha_1$ is not necessarily equal to $\alpha_2$. The angle chosen for $\alpha_2$ should be a constant for a given antenna design. An antenna heretofore constructed in accordance with the invention had a length of approximately 20 meters.

A wire which can be readily utilized for the zig-zag antenna of FIGS. 1 and 2 is a commercially available 7-strand, No. 12 AWG (American Wire Gauge), made of Sn/Cu. The zig-zag antenna requires a pair of supporting masts 12 (FIG. 1) and the antenna itself is strung between a pair of synthetic ropes 13. Guying tensions are about 10 kilograms (22 lbs.). This compares quite favorably with a LPDA which typically requires a catenary tension of several hundred kilograms due to the large distance between supporting masts or towers.

Figure 3:
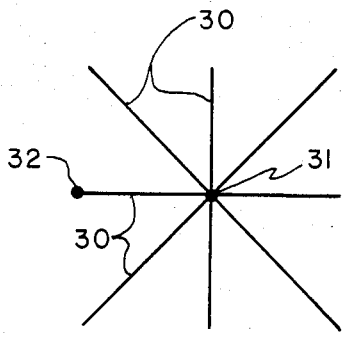
FIG. 3 illustrates a typical counterpoise.

A counterpoise such as shown in FIG. 3 is needed to balance the antenna system. The FIG. 3 counterpoise comprises four counterpoise wires 30, the wire used being similar to the wire utilized for the zig-zg antenna. The counterpoise is preferably 20 or more meters square for good balance. However, as will be evident to those skilled in the art, the discrete counterpoise of FIG. 3 may not be necessary in all instances. For example, if the chosen site consists of moist or damp soil then ground stakes may be substituted for the counterpoise of FIG. 3. For dry or sandy soil a discrete counterpoise is probably necessary.

Figure 4:
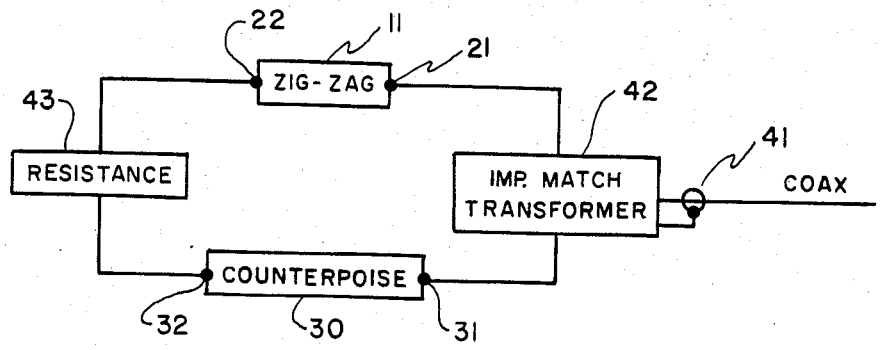
FIG. 4 is a block schematic diagram of the antenna system of the invention.

Referrring now to FIG. 4, the zig-zag antenna 11 has a characteristic impedance of 600 ohms. If a 50 ohm coaxial transmission line 41 is used to deliver the power, a 12:1 BALUN (balanced-to-unbalanced) transformer 42 is used for impedance matching purposes. And, for a 75 ohm transmission line, an 8:1 transformer would be needed. The antenna is terminated with a 600 ohm resistance 43 (e.g., a power rated resistor or a load line) in order to maintain the characteristic impedance over the entire frequency range.

The zig-zag antenna receives power at the feedpoint 21 via the impedance matching transformer. The currents that are induced on the antenna cause power to radiate at low elevation angles. The radiating efficiency of the antenna is frequency dependent so the terminating resistance attenuates any portion of the power that is not radiated. The reference numerals 21 and 22 of FIG. 2 indicate the connection points of the zig-zag 11 to the transformer 42 and resistance 43 of FIG. 4. Also, in FIG. 4, the transformer 42 and resistance 43 are respectively connected to the counterpoise of FIG. 3 at points 31 and 32.

Unlike all other known prior art antennas, the broadband (3–30 MHz), HF non-resonant, log-periodic, directional antenna of the present invention achieves a single main beam by virtue of satisfying the Hanson-Woodyard condition for increased directivity. The Hanson-Woodyard condition for an increased directivity array is one of the few instances where it is practical to obtain more directivity than would normally be obtained from an array of given size. For a brief discussion of the Hanson-Woodyard condition see the text entitled "Antennas" by J. D. Kraus, McGraw-Hill Book Co. (1950), page 81.

Figure 5:
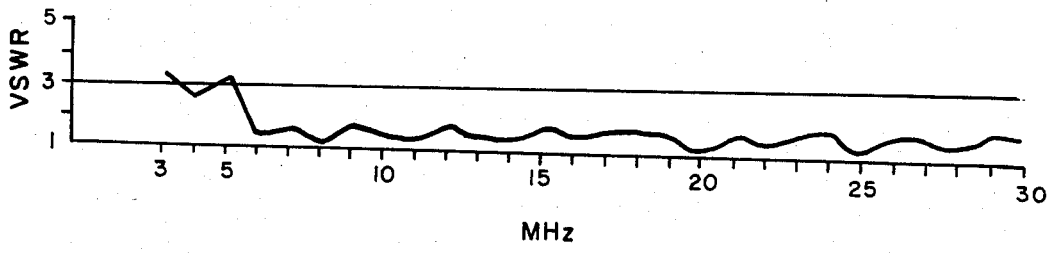
FIG. 5 shows the VSWR over the 3–30 MHz band for this zig-zag antenna system.

A broadband (3–30 MHz) zig-zag antenna constructed in accordance with the preferred embodiment of the invention exhibited the VSWR characteristic illustrated in FIG. 5 of the drawings. As is known to those skilled in the art, a low VSWR is desirable for maximum power transfer. Over the entire 3–30 MHz band the zig-zag antenna had a VSWR of about 3 or less—and from 6–30 MHz the VSWR$\leqq$2.

Figure 6:
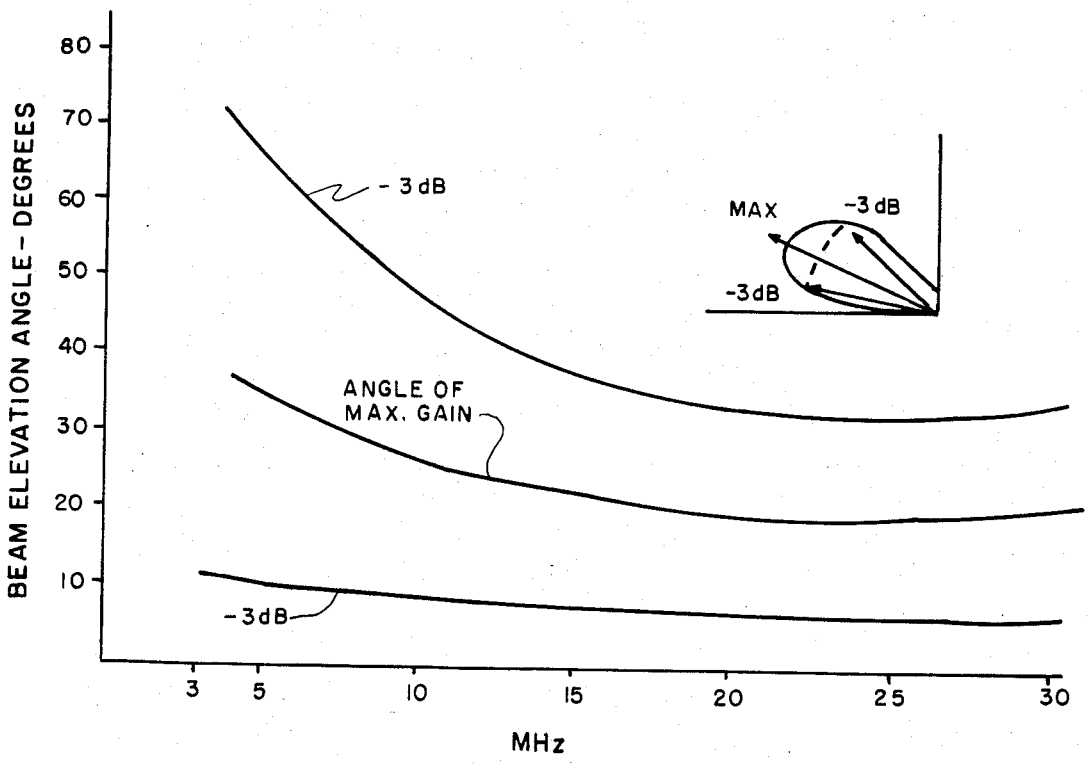
FIG. 6 shows curves of take-off angle vs. frequency for the zig-zag antenna system of the invention.

FIG. 6 shows curves of take-off angle vs. frequency for the preferred embodiment of the invention. For illustrative purposes, the curves have been smoothed from the raw data that was obtained. As will be evident to those skilled in this art, the curves indicate that the zig-zag antenna of the invention is excellent for medium to long-range (e.g., 4000 km) sky-wave communication.

The antenna of the present invention has constant impedance and radiation-pattern characteristics. Therefore, this zig-zag antenna is suitable for use with frequency hopping HF transmission, or other spread-spectrum techniques, as well as single frequency operation.

The performance of the zig-zag antenna of the invention is, at the least, comparable to that of the conventional vertical log-periodic antenna (VLP). Moreover, an antenna constructed in accordance with the present invention is only about 1/10 the size of a VLP; its weight is approximately 1/50 that of a VLP; and its cost is also about 1/50 of that of a VLP. Thus, unlike the VLP, the antenna of the invention is readily transportable (when collapsed), it can be set up by only one man, and it can be sited on a relatively small piece of land (e.g., $\leqq 100\times 20$ feet). And, because of its weight it can be erected on even soft ground without the need of concrete reinforcements.

While a specific embodiment of the invention has been described in detail, it is to be understood that numerous modifications and variations therein may be devised by those skilled in the art without departing from the spirit and scope of the invention.

What is claimed is:

1. A broadband antenna system comprising a pair of support lines, one of said support lines being horizontal and the other at a vertical angle of 30°±5° to the horizontal, a length of antenna wire strung continuously between said support lines in a vertical zig-zag manner so as to present a plurality of interconnected inverted-V sections, said plurality being equal to ten±two, the legs of each inverted-V section meeting at the ends thereof with the ends of the legs of inverted-V sections immediately adjacent thereto, each inverted-V section providing a spatial phase reversal to the current from leg-to-leg, the angle between adjacent legs of the inverted-V sections being a constant equal to 30°±5°, impedance matching transformer means for coupling input signals to the shortest of the inverted-V sections, resistance means connected to the tallest of the inverted-V sections for terminating the antenna in its characteristic impedance, and counterpoise means coupled to said resistance means and said transformer means and serving to balance the zig-zag antenna.

2. An antenna system as defined in claim 1 wherein said zig-zag antenna is non-resonant.

3. An antenna system as defined in claim 2 wherein said zig-zag antenna is comprised of 7-strand, number 12 AWG wire having a copper core and tin cladding.

* * * * *